US012194598B2

(12) United States Patent
Klacking

(10) Patent No.: US 12,194,598 B2
(45) Date of Patent: Jan. 14, 2025

(54) DETACHABLE GRINDING TOOL

(71) Applicant: SlurryMonster, LLC, Livonia, MI (US)

(72) Inventor: Ryan Klacking, Canton, MI (US)

(73) Assignee: Slurry Monster, LLC, Livonia, MI (US)

( * ) Notice: Subject to any disclaimer, the term of this patent is extended or adjusted under 35 U.S.C. 154(b) by 438 days.

(21) Appl. No.: 17/367,039

(22) Filed: Jul. 2, 2021

(65) Prior Publication Data

US 2022/0331927 A1 Oct. 20, 2022

Related U.S. Application Data

(60) Provisional application No. 63/175,911, filed on Apr. 16, 2021.

(51) Int. Cl.
*B24B 7/18* (2006.01)
*B24B 41/047* (2006.01)
*B24D 7/06* (2006.01)

(52) U.S. Cl.
CPC ..... *B24B 7/186* (2013.01); *B24B 41/047* (2013.01); *B24D 7/066* (2013.01)

(58) Field of Classification Search
CPC ..... B24B 7/186; B24B 41/047; B24B 23/005; B24B 23/02; B24B 23/022; B24B 23/046; B24B 7/18; B24B 41/002; B24B 41/0475; B24D 7/066; B24D 2201/00; B24D 7/16; B24D 7/06
USPC ..... 451/344, 494, 353, 359, 548
See application file for complete search history.

(56) References Cited

U.S. PATENT DOCUMENTS

| | | | | |
|---|---|---|---|---|
| 5,567,503 | A * | 10/1996 | Sexton | B24D 3/30 428/323 |
| 8,585,466 | B2 * | 11/2013 | Van Eijden | B24D 7/066 451/353 |
| 11,130,210 | B2 * | 9/2021 | Gallup | B24B 7/186 |
| 2018/0290264 | A1 * | 10/2018 | Li | B24D 5/06 |
| 2019/0118329 | A1 * | 4/2019 | Eisenmann | B24B 23/005 |
| 2022/0001515 | A1 * | 1/2022 | Tchakarov | B24D 9/085 |

FOREIGN PATENT DOCUMENTS

CN 210849499 U * 6/2020

* cited by examiner

*Primary Examiner* — Laura C Guidotti
*Assistant Examiner* — Caleb Andrew Holizna
(74) *Attorney, Agent, or Firm* — Carlson, Gaskey & Olds, P.C.

(57) ABSTRACT

A grinding head assembly for a floor processing machine includes a plate that has a first side that has a tool attachment surface and a second side opposite the first side. A plurality of lippage adapters are attached to the second side of the plate. The plurality of lippage adapters each include a base portion that have a tool contact surface partially surrounded at a perimeter wall and are removably attached to the second side of the plate with at least one fastener. Each of the plurality of lippage adapters includes at least one magnet fixed to the base portion.

10 Claims, 7 Drawing Sheets

DETACHABLE GRINDING TOOL

REFERENCE TO RELATED APPLICATIONS

This application claims the benefit of U.S. Provisional Application No. 63/175,911 filed Apr. 16, 2021.

BACKGROUND

The present disclosure relates to a device and method for attaching a tool to a grinding plate for use with a floor processing machine.

Floor processing machines can engage and process large floor areas in a single day. However, the tools on the machine that engage the floor surface eventually reach a serviceable lifespan and need to be replaced. Alternatively, the same floor processing machine is used to perform different functions such as grinding, polishing, or honing and requires a different tool to perform each function. This requires a user of the floor processing machine to regularly change the tools that engage the floor surface. This process can be lengthy and detract from time spent processing the floor.

SUMMARY

In one exemplary embodiment, a grinding head assembly for a floor processing machine includes a plate that has a first side that has a tool attachment surface and a second side opposite the first side. A plurality of lippage adapters are attached to the second side of the plate. The plurality of lippage adapters each include a base portion that have a tool contact surface partially surrounded at a perimeter wall and are removably attached to the second side of the plate with at least one fastener. Each of the plurality of lippage adapters includes at least one magnet fixed to the base portion.

In another embodiment according to any of the previous embodiments, the base portion is circular. The perimeter wall is arcuate and extends perpendicularly from the base portion.

In another embodiment according to any of the previous embodiments, the perimeter wall includes two arcuate portions separated by discontinuities in the perimeter wall that extend to the base portion.

In another embodiment according to any of the previous embodiments, the discontinuities include at least two discontinuities.

In another embodiment according to any of the previous embodiments, a mounting plate has a pair of anti-rotation tabs extending outward from a perimeter of the mounting plate.

In another embodiment according to any of the previous embodiments, a first side of the mounting plate includes a base portion contact surface. A second side of the mounting plate includes one of a hook or loop fastener.

In another embodiment according to any of the previous embodiments, a backer surface of a tool includes the other of the hook or loop fastener for engaging the attachment plate.

In another embodiment according to any of the previous embodiments, the pair of anti-rotation tabs are coplanar with a central region of the mounting plate.

In another embodiment according to any of the previous embodiments, the central region of the mounting plate follows a contour of the perimeter wall.

In another embodiment according to any of the previous embodiments, the pair of anti-rotation tabs are spaced 180 degrees from each other about a perimeter of the mounting plate.

In another embodiment according to any of the previous embodiments, the at least one magnet is recessed into a pocket in the base portion and includes a magnet face flush with a face of the base portion.

In another embodiment according to any of the previous embodiments, a mounting plate has a pair of anti-rotation tabs that extend outward from a perimeter of the mounting plate. An insert is fixed to the mounting plate and sized to fit within the perimeter wall of the lippage adapter and at least partially surround the tool.

In another embodiment according to any of the previous embodiments, a first side of the mounting plate includes a base portion contact surface. A second side of the mounting plate includes one of a hook or loop fastener. The insert includes the other of the hook or loop fastener.

In another embodiment according to any of the previous embodiments, the base portion includes at least one post opening for accepting a post on a tool.

In another embodiment according to any of the previous embodiments, an insert is sized to fit within the perimeter wall of the lippage adapter and at least partially surround the tool.

In another exemplary embodiment, a method of attaching a tool to a grinding plate includes placing a tool adjacent a lippage adapter attached to a grinding plate. The lippage adapter includes a base portion partially surrounded by a perimeter wall that has a pair of discontinuities. At least one alignment feature is aligned fixed relative to the tool with an alignment feature on the lippage adapter.

In another embodiment according to any of the previous embodiments, the tool is attached to a mounting plate. The mounting plate has one of a hook or loop fastener and the tool has the other of the hook or loop fastener.

In another embodiment according to any of the previous embodiments, aligning at least one alignment feature. The aligning includes aligning a pair of tabs on the mounting plate with a corresponding one of the pair of discontinuities.

In another embodiment according to any of the previous embodiments, the tool is a non-ferrous based tool. An insert is sized to fit within the perimeter wall and at least partially surround the tool.

In another embodiment according to any of the previous embodiments, aligning at least one alignment feature includes aligning at least one post fixed to the tool with a post opening in the lippage adapter. The tool is a ferrous based tool.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
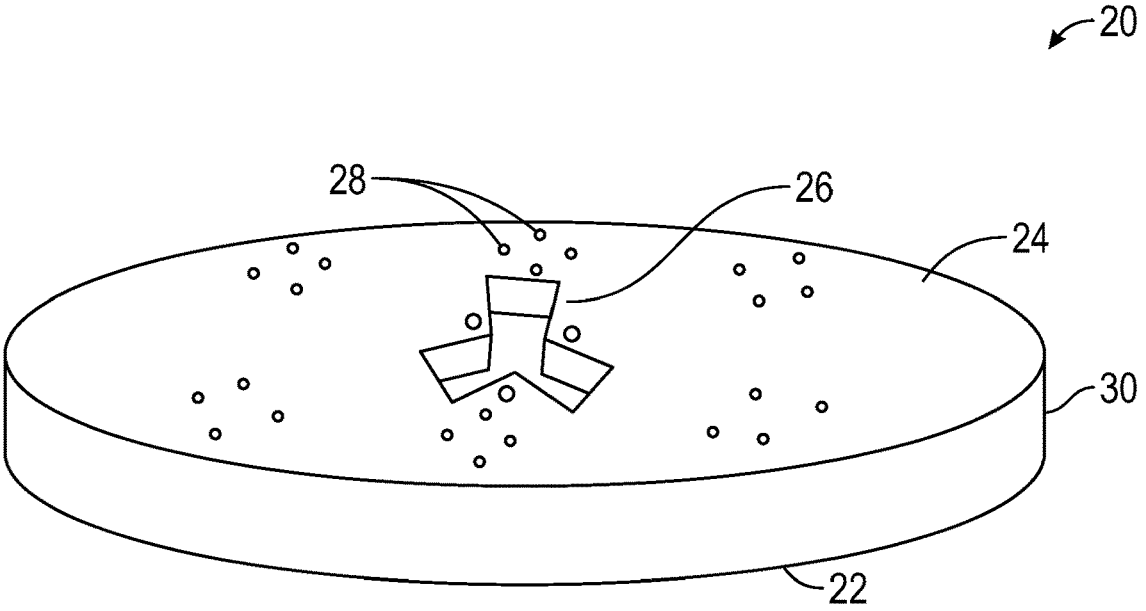
FIG. 1 illustrates a perspective view of an example grinding plate.

FIGS. 1 illustrates an example grinding plate 20 for use with a floor processing machine, such a rotary floor grinding machine. The grinding plate 20 includes a first surface 22 for contacting a tool head on the grinder machine and a second surface 24 opposite the first surface 22. In the illustrated example, the first and second surface 22, 24 are circular, but other shapes could be used. The first and second surfaces 22, 24 are connected by a thickness 30 of the plate 20. A central region of the plate 20 includes a keyway 26 and a plurality of fastener openings 32 surrounding the keyway 26 for attaching to the floor processing machine with fasteners.

Figure 2:
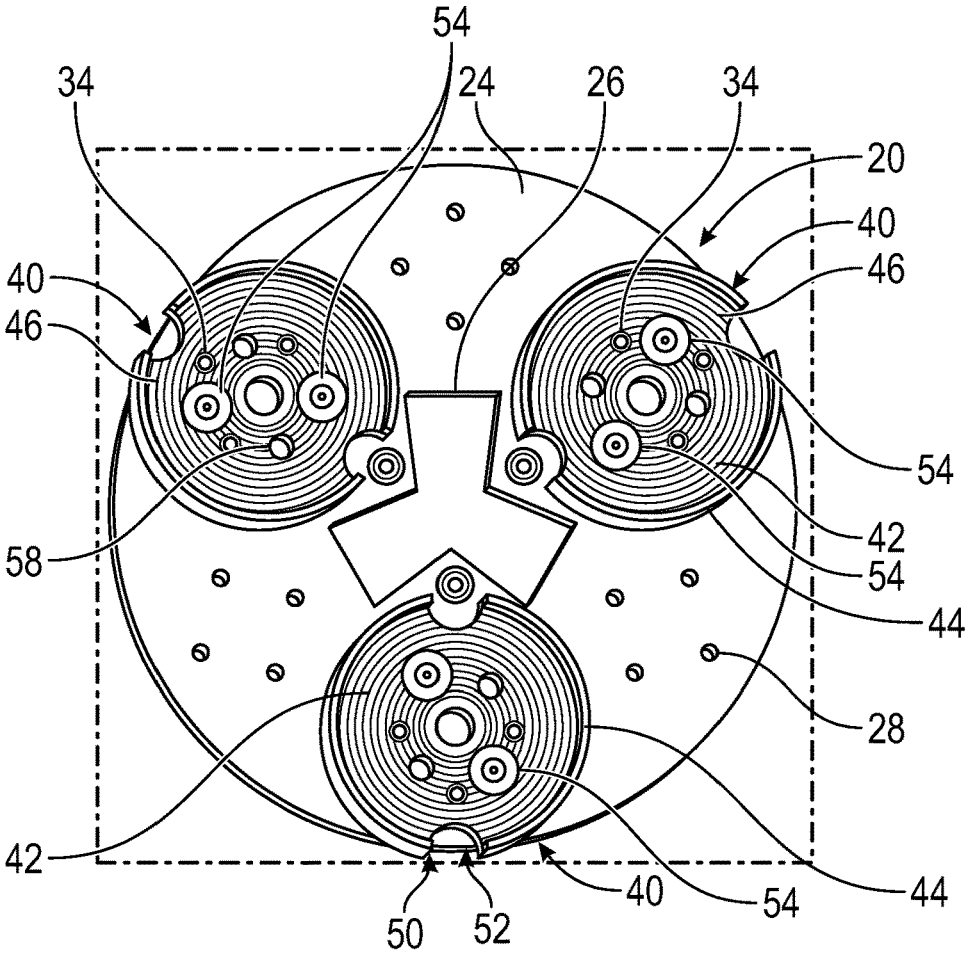
FIG. 2 illustrates an example grinding plate assembly with multiple lippage adapters.

A plurality of attachment holes 28 are located in the second surface 24 for attaching one of the lippage adapters 40 (FIG. 2). The attachment holes 28 may extend completely through the plate 20 and have threaded or smooth side walls for engaging a fastener 34 (FIG. 2), such as a screw or a bolt. Alternatively, the attachment holes 28 may extend partially through the grinding plate 20 and include a threaded side wall for engaging the fastener 34.

As shown in FIG. 2, a plurality of lippage adapters 40 are equally spaced circumferentially on the second surface 24 of the plate 20. In the illustrated example, there are three lippage adapters 40 attached to the second surface 24. However, more lippage adapters 40 may be attached to the plate 20 depending on the application.

Figure 3:
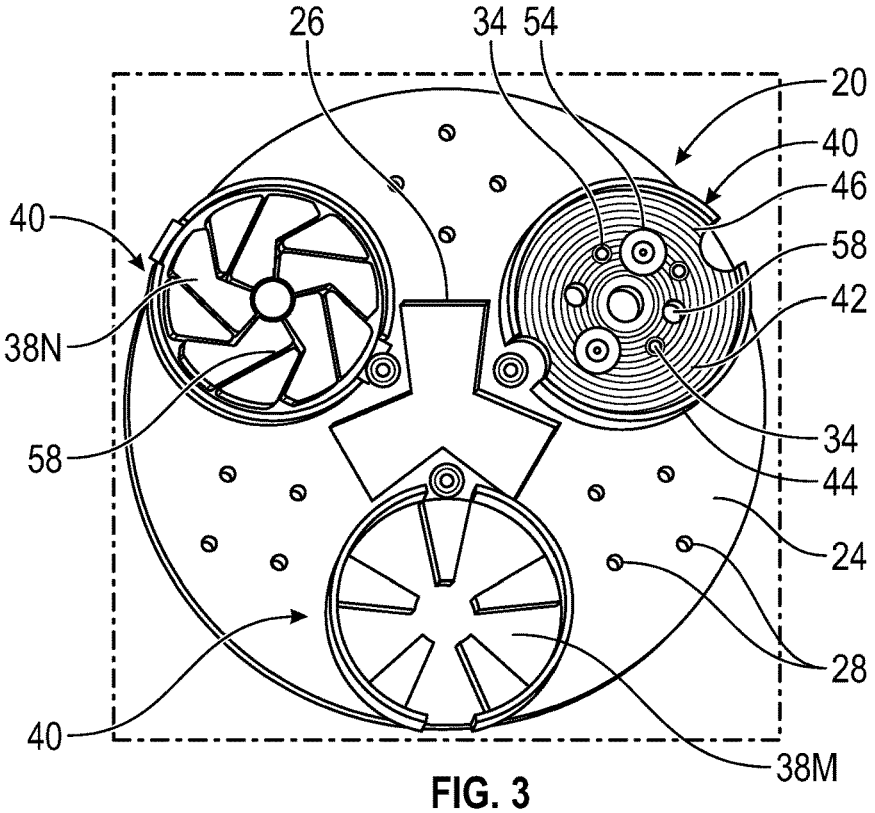
FIG. 3 illustrates the grinding plate assembly of FIG. 2 with multiple tools.
Figure 4:
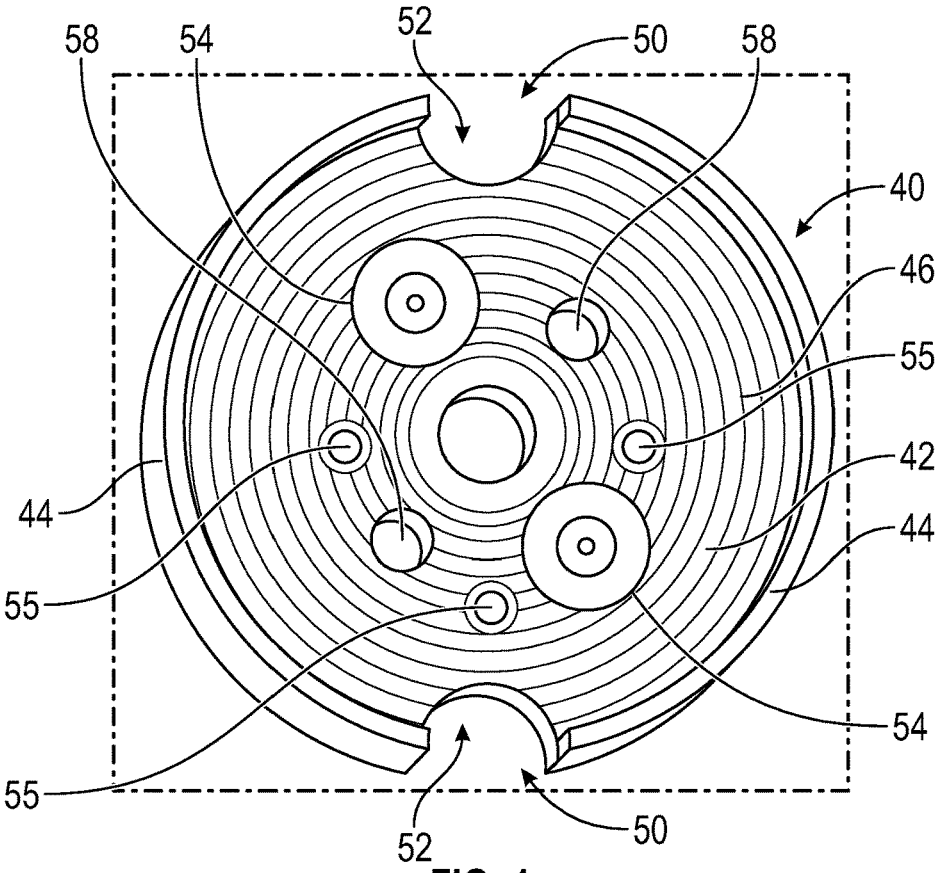
FIG. 4 illustrates a bottom view of one of the lippage adapters.
Figure 5:
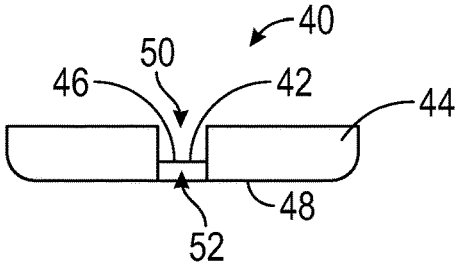
FIG. 5 illustrates a side view of one of the lippage adapters.

As shown in FIG. 3, the lippage adapters 40 on the plate 20 can secure non-magnetic based tool 38N, such as resin insert, or a magnetic tool 38M, such as carbide or diamond tool with magnetic properties, that are attached directly by a magnet 54 (FIG. 4).

As shown in FIGS. 2-5, the lippage adapters 40 each include a base portion 42 and a perimeter wall 44. In the illustrated example, the base portion 42 is planar and the perimeter wall 44 is made of two arcuate portions extending perpendicularly from the base portion 42. The base portion 42 includes a tool contact surface 46 partially surrounded by the perimeter wall 44 and a grinding plate contact surface 48 (FIG. 5) opposite the tool contact surface 46. The lippage adapters 40 may be formed from a single piece of material, such as aluminum, and stamped and/or machined.

The fasteners 34 allow the lippage adapters 40 to be removably attached to the grinding plate 20. The arcuate portions of the perimeter wall 44 define discontinuities 50 in the perimeter wall 44 that are circumferentially aligned with a recess 52 that extends into the base portion 42. One feature of the discontinuity 50 and the recess 52 is the ability to easily remove the tool 38N or 38M from the lippage adapter 40.

Figure 6:
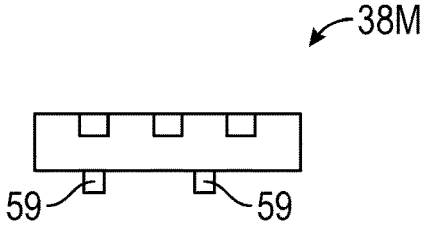
FIG. 6 illustrates a side view of a tool with posts.

The base portion 42 also includes the magnet 54 that is either flush with the tool contact surface 46 or recessed relative to the tool contact surface 46 to allow the tool 38N, 38M to sit flush into the lippage adapter 40. The base portion 42 also includes a plurality of fastener openings 55 (FIG. 4) for accepting the fasteners 34 and at least one post opening 58 for accepting a post 59 on a rear side of the tool 38M. The post openings 58 are offset from a center of the lippage adapter 40 and operate as an alignment feature for the tool 38M. While the tool 38M shown in FIG. 6 includes two posts, the tool 38M could also only include a single post to allow the tool 38M to rotate slightly within the lippage adapter 40 limited by a clearance between a perimeter of the tool 38M and the perimeter wall 44.

Figure 7:
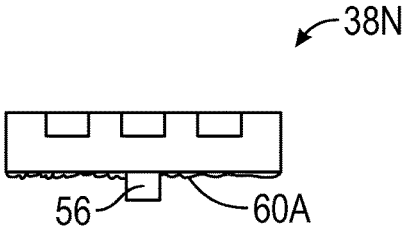
FIG. 7 illustrates a side view of another tool with one of a hook or loop fastener.
Figure 8:
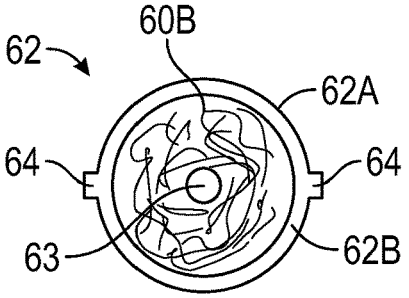
FIG. 8 illustrates an example mounting plate with the other one of the hook or loop fastener on the tool of FIG. 7.
Figure 9:
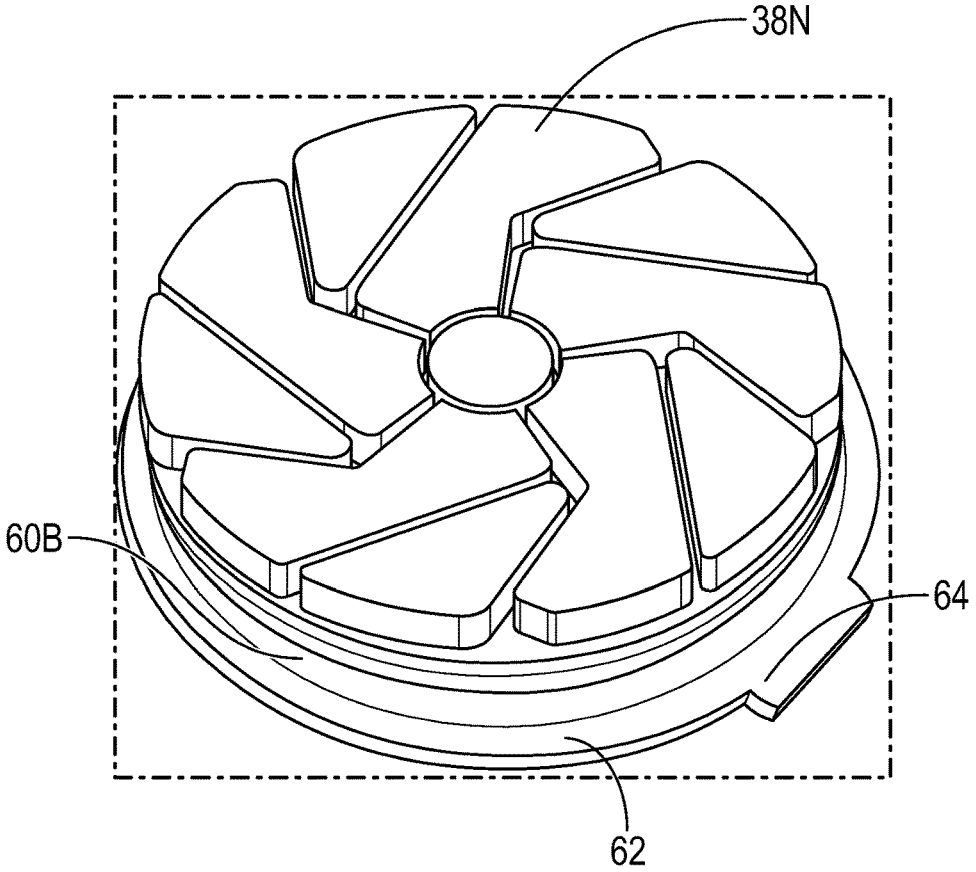
FIG. 9 illustrates a perspective view of a tool attached to the mounting plate of FIG. 8.

As shown in FIG. 7-9, the non-magnetic tool 38N includes at least one of a hook or loop fastener 60A on a rear side of the non-magnetic tool 38N and a mounting plate 62 includes the other of the hook or loop fastener 60B. One feature of having the non-magnetic tool 38N with one of the hook or loop fasteners 60A, 60B attached to the mounting plate 62 is that the non-magnetic tool 38N can remain attached to the same mounting plate 62 for the life of the tool 38N. This avoids debris collecting in the hook or loop fasteners 60A, 60B that would weaken the connection of the non-magnetic tool 38N, such that the tool 38N may no longer be attachable prior to reaching serviceable lifespan.

Figure 10:
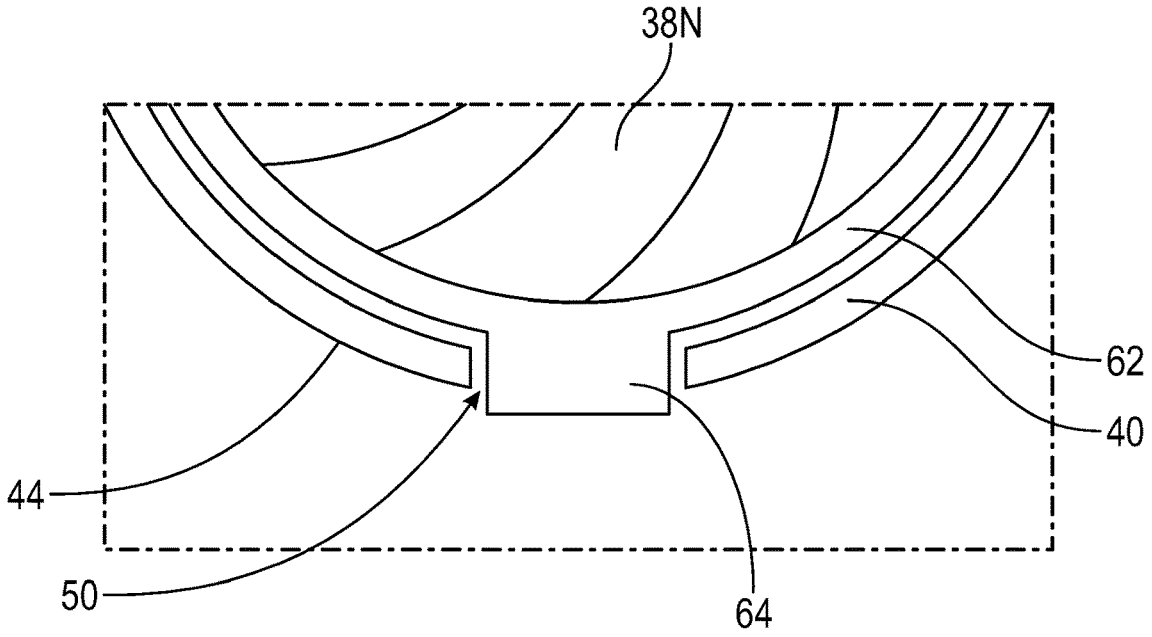
FIG. 10 is an enlarged view of the tool on the mounting plate of FIG. 8 with a tab engaging the lippage adapter.

In the illustrated example, the mounting plate 62 is circular and follows a contour of the perimeter wall 44 and includes with a pair of outwardly extending anti-rotation tabs 64, a first side having a base portion contact surface 62A, and a second side having a tool attachment surface 62B with one of the hook or loop fastener 60B. The anti-rotation tabs 64 are spaced 180 degrees from each other around a perimeter of the mounting plate 62 and also operate as an alignment feature for the tool 38N. As shown in FIG. 10, the tabs 64 include a width equal to or less than a width of the discontinuities 50 in the perimeter wall 44. One feature of the tabs 64 and the discontinuities is an anti-rotation function such that lateral edges of the tabs 64 engage the perimeter wall 44 at the discontinuities 50 to reduce or eliminate rotation of the mounting plate 62 relative to the lippage adapter 40. Additionally, the tabs 64 are coplanar with a remainder of the mounting plate 62.

Furthermore, the mounting plate 62 may include a central opening 63 aligned with an opening in the hook or loop fastener 60B for accepting a post 56 on the tool 38N. One feature of the central opening 61 and the post 56 is the ability to align tool 38N with the mounting plate 62 if designed.

Figure 11:
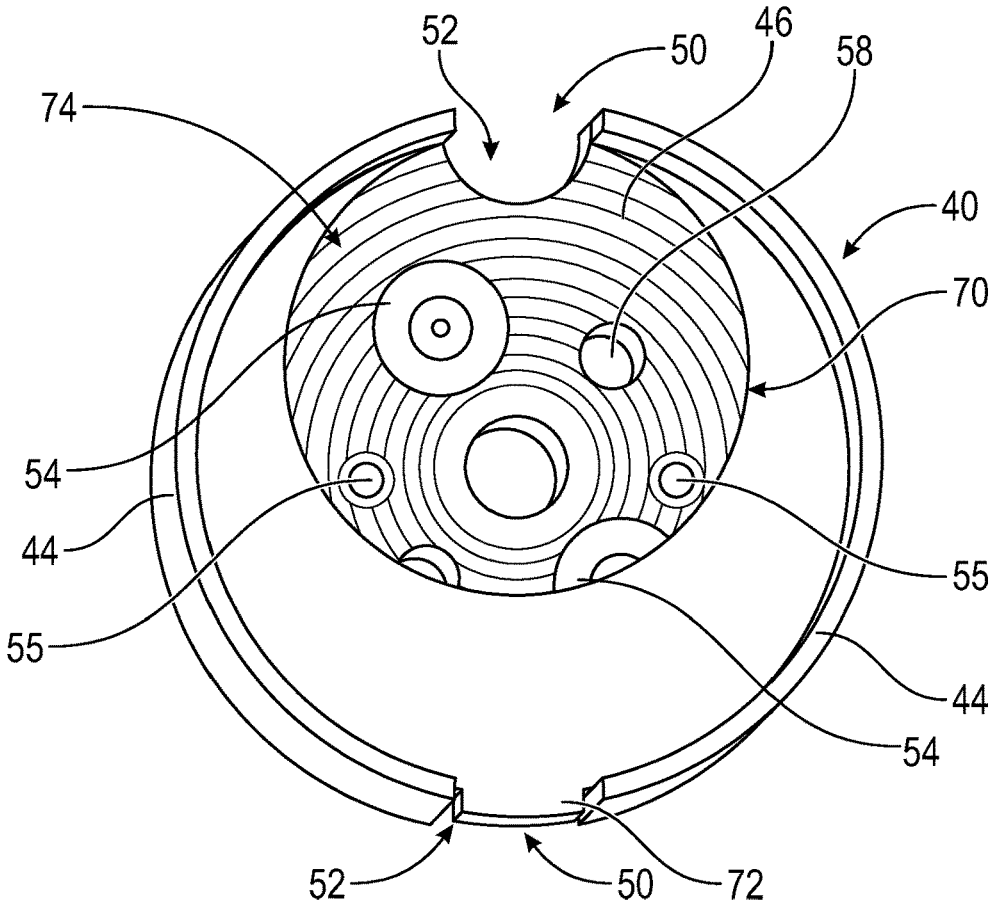
FIG. 11 illustrates one of the lippage adapters with an insert.
Figure 12:
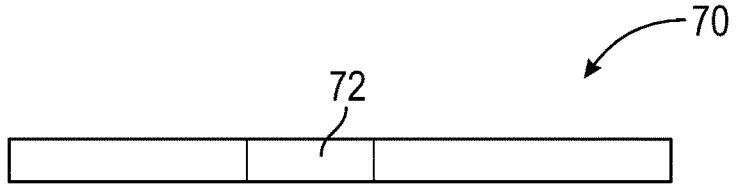
FIG. 12 illustrates a side view of the insert of FIG. 11.
Figure 13:
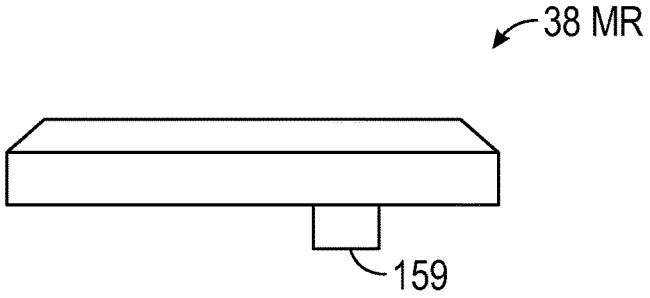
FIG. 13 illustrates a side view of a magnetic tool of reduced diameter.
Figure 17:
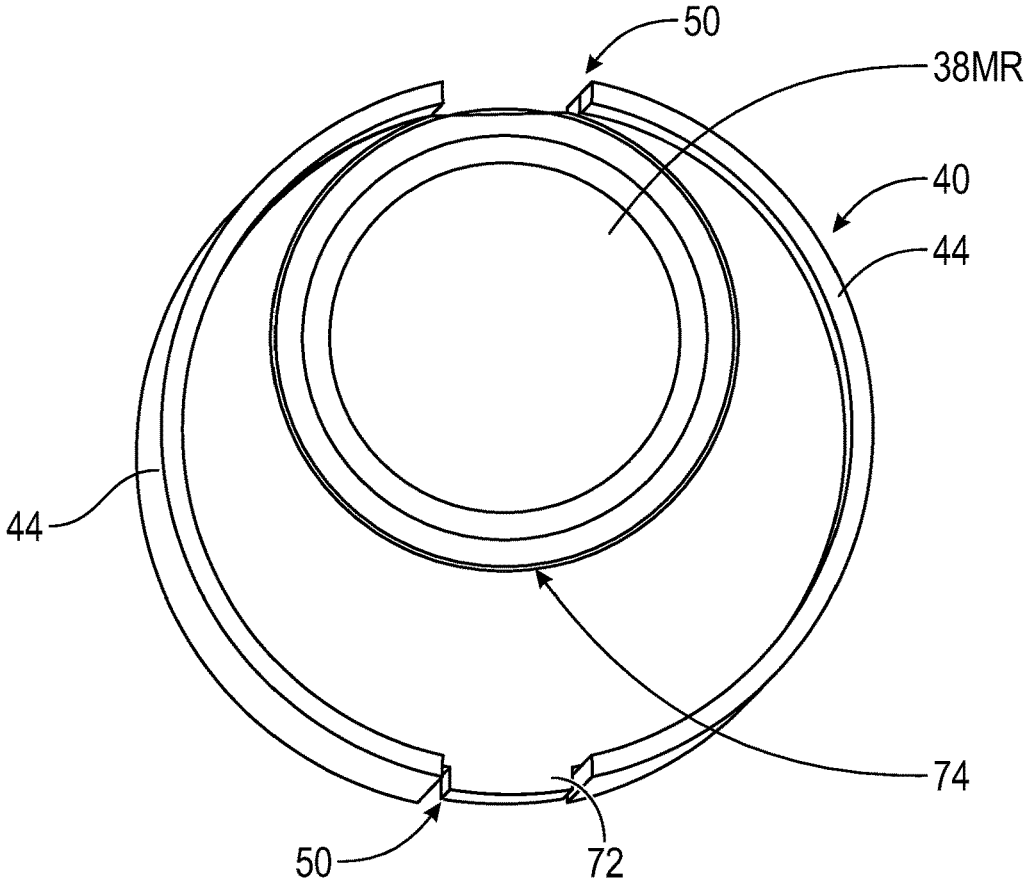
FIG. 17 illustrates a tool with the insert of FIGS. 11-12.

FIG. 11 illustrates an example insert 70 for use with the lippage adapter 40. The insert 70 fits within the perimeter wall 44 of the lippage adapter 40 and includes an anti-rotation tab 72 that aligns with one of the discontinuities 50 in the perimeter wall 44. The tab 72 serves as an alignment feature. A circular opening 74 is located adjacent a leading edge side of the lippage adapter 40 for accepting a magnetic tool 38MR of reduced diameter compared to the diameter of the perimeter wall 44. The circular opening 74 is offset in the insert 70 and adjacent one of the discontinuities 50 in the perimeter wall 44 and the opening 74 may not be entirely circumscribed by the insert 70 such that extends through a perimeter of the insert 70 (FIG. 17). One feature of insert 70 is the ability to use the same lippage adapter 40 with different diameter tools 38. Also, placement of the magnetic tool 38MR adjacent the leading edge of the lippage adapter 40 improves the useable life the magnetic tool 38MR over placing the magnetic tool 38MR in a center of the insert 70.

Additionally, the opening 74 is aligned with one of the magnets 54 in the tool contact surface 46 to allow the magnetic tool 38MR to magnetically attach to the lippage adapter 40. The insert 70 can also be of a magnetic attractive material such that the other magnet 54 may further secure the insert 70 to the lippage adapter 40. The tool 38MR includes a post 159 that fits within the post opening 58 in the lippage adapter 40 to further prevent rotation of the magnetic tool 38MR relative to the lippage adapter 40. In particular, lateral edges of the magnetic tool 38MR engage the insert 70 to prevent rotation of the magnetic tool 38MR relative to the lippage adapter 40.

Figure 14:
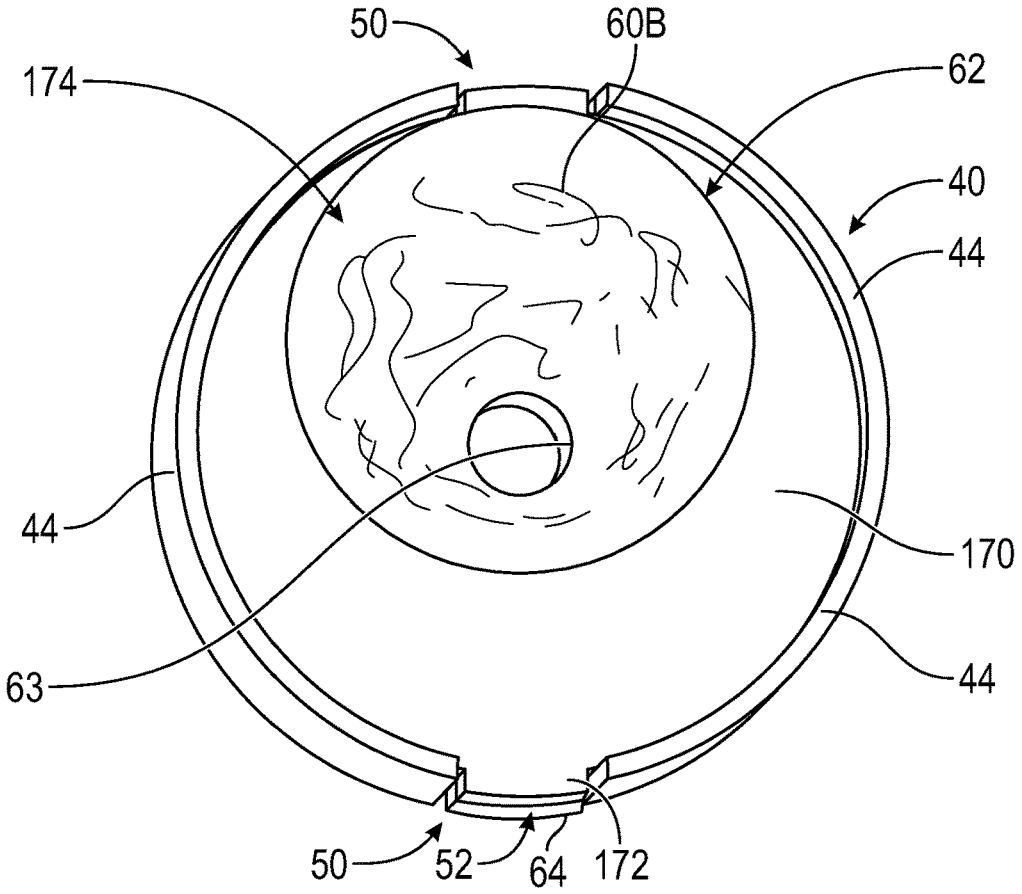
FIG. 14 illustrates one of the lippage adapters with an insert.
Figure 18:
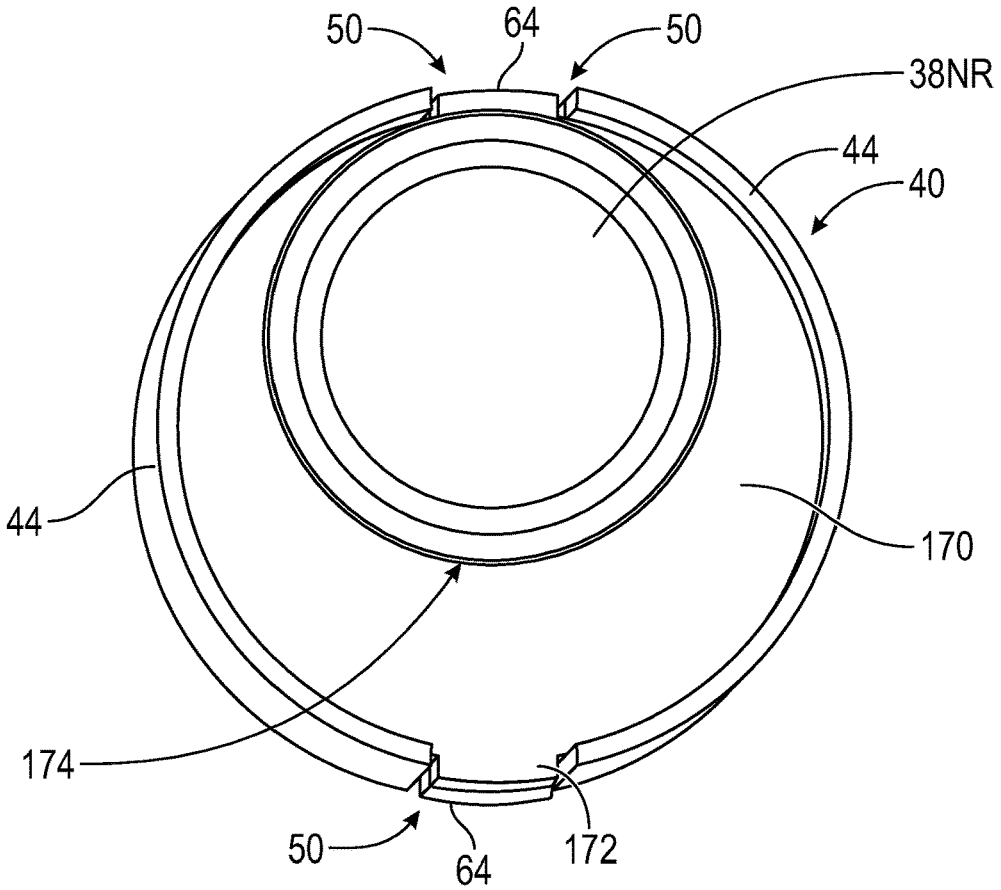
FIG. 18 illustrates a tool with the inserts of FIGS. 14-15.

FIG. 14 illustrates another example insert 170 used with the lippage adapter 40. The insert 170 is similar to the insert 70 except where described below or shown in the Figures. The insert 170 fits within the perimeter wall 44 of the lippage adapter 40 and includes an anti-rotation tab 172 that aligns with one of the discontinuities 50 in the perimeter wall 44. The tab 172 serves as an alignment feature. A circular opening 174 is located adjacent a leading edge side of the lippage adapter 40 for accepting a non-magnetic tool 38NR of reduced diameter compared to the diameter of the perimeter wall 44. The opening 174 is offset in the insert 170 and adjacent one of the discontinuities 50 in the perimeter wall 44 and the opening 174 may not be entirely circumscribed by the insert 170 such that extends through a perimeter of the insert 170 (FIG. 18). Also, placement of the non-magnetic tool 38NR adjacent the leading edge of the lippage adapter 40 improves the serviceable life the non-magnetic tool 38NR over placement in a center of the insert 170.

Figure 15:
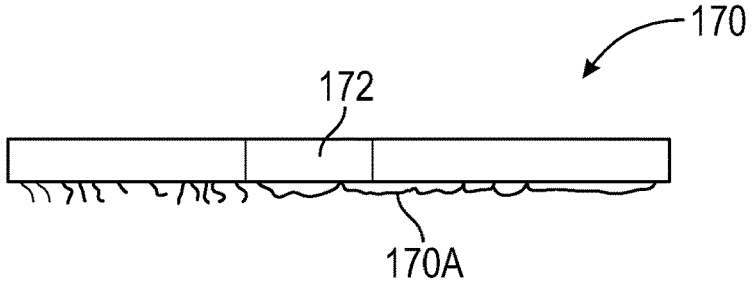
FIG. 15 illustrates a side view of the insert of FIG. 14.
Figure 16:
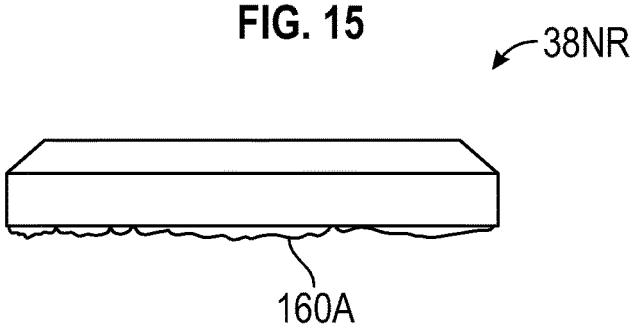
FIG. 16 illustrates a side view of a magnetic tool of reduced diameter.

As shown in FIGS. 14-16, the insert 170 is used in connection with the mounting plate 62. The insert 170 includes one of a hook and loop fasteners 170A that mates with the other of the hook and loop fastener 60B on the mounting plate 62. Because the insert 170 does not need to be attracted by one of the magnets 54, it can be made of a polymeric material instead of a metallic material like the insert 70. The mounting plate 62 is secured relative to the lippage adapter 40 by the magnets 54. One of the discontinuities 50 includes the tab 64 on the mounting plate 62 and the tab 172 on the insert 170 while the other of the discontinuities 50 only includes one of the tabs 64 on the mounting plate 62. The non-magnetic tool 38NR fits within the opening 174 in the insert 170 and includes one of the hook and loop fasteners 160A that mates with the other of the hook and loop fasteners 60B on the mounting plate 62.

Figure 19:
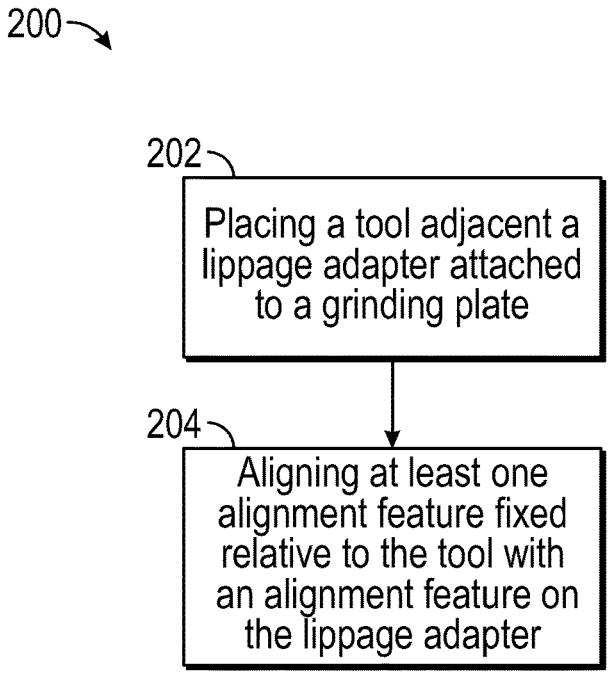
FIG. 19 illustrates an example method of attaching the tool to one of the lippage adapters.

FIG. 19 illustrates a method 200 of attaching one of the tools 38N or 38M to the grinding plate 20. The method 200 includes placing one of the tools 38 into proximity with one of the lippage adapters (Block 202). The tools 38 must be aligned with the lippage adapter 40 to allow the magnet 54 to draw the tool 38 into the lippage adapter 40. With the tools 38N or 38NR, the magnet 54 draws the mounting plate 62 attached to the tool 38N into the lippage adapter 40. The tool 38N is attached to the mounting plate 62 with the hook or loop fasteners 60A, 60B, 160A and the tabs 64 must be aligned with the discontinuities in the perimeter wall 44 to allow the mounting plate 62 to fit flush against the base portion 42 of the lippage adapter 40. (Block 204). With the tool 38NR, the tab 172 on the insert 170 must also be aligned with the discontinuity 50. The inset 170 can be attached at the same time as the tool 38NR or prior to the tool 38NR.

With the tools 38M or 38MR, one or more posts 59 or 159, respectively, must be aligned with post openings 58 in the base portion 42 to allow the tool 38M or 138 MR to sit flush against the base portion 42. With the tool 38MR, the tab 72 on the insert 70 must also be aligned with the discontinuity 50. The inset 70 can be attached at the same time as the tool 38MR or prior to the tool 38NR.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A grinding head assembly for a floor processing machine comprising:

a plate having a first side having a tool attachment surface and a second side opposite the first side;

a plurality of lippage adapters attached to the second side of the plate, wherein at least one of the plurality of lippage adapters includes a circular base portion having a tool contact surface partially surrounded at an arcuate perimeter wall, and includes at least one magnet fixed to the base portion; and an insert provided within the perimeter wall and having a circular insert opening adjacent a leading edge of the at least one lippage adapter, wherein the insert opening is non-concentric with the base portion and is aligned with a magnet of the at least one magnet.

2. The grinding head assembly of claim 1, wherein the base portion provides a post opening, and the insert opening is aligned with the post opening, such that a magnetic tool having a post can be received within the insert opening and the post opening.

3. The grinding head assembly of claim 2, wherein the insert includes a tab received within a first discontinuity in the perimeter wall.

4. The grinding head assembly of claim 3, wherein the insert opening is adjacent a second discontinuity in the perimeter wall diametrically opposite the first discontinuity.

5. The grinding head assembly of claim 4, wherein the insert comprises a magnetic attractive material.

6. The grinding head assembly of claim 1, wherein the insert comprises a magnetic attractive material.

7. The grinding head assembly of claim 1, wherein the insert includes a tab received within a first discontinuity in the perimeter wall, and the insert opening is adjacent a second discontinuity in the perimeter wall diametrically opposite the first discontinuity.

8. The grinding head assembly of claim 1, wherein the at least one of the plurality of lippage adapters is removably attached to the second side of the plate with at least one fastener.

9. The grinding head assembly of claim 1, wherein the at least one magnet is recessed into a pocket in the base portion and includes a magnet face flush with a face of the base portion.

10. The grinding head assembly of claim 9, wherein the base portion provides a post opening, and the insert opening is aligned with the post opening, such that a magnetic tool having a post can be received within the insert opening and the post opening;

the insert includes a tab received within a first discontinuity in the perimeter wall, and the insert opening is adjacent a second discontinuity in the perimeter wall diametrically opposite the first discontinuity;

the insert comprises a magnetic attractive material; and the at least one of the plurality of lippage adapters is removably attached to the second side of the plate with at least one fastener.

* * * * *